US009743779B2

(12) United States Patent
Zhao et al.

(10) Patent No.: US 9,743,779 B2
(45) Date of Patent: Aug. 29, 2017

(54) INFANT CHAIR APPARATUS

(71) Applicant: Wonderland Nurserygoods Company Limited, Kwai Chung N.T. (HK)

(72) Inventors: Guang-Hui Zhao, Kwai Chung (HK); Wei-Huan Liu, Kwai Chung (HK); Man-Qun Cheng, Kwai Chung (HK)

(73) Assignee: Wonderland Nurserygoods Company Limited, Hong Kong (HK)

( * ) Notice: Subject to any disclaimer, the term of this patent is extended or adjusted under 35 U.S.C. 154(b) by 181 days.

(21) Appl. No.: 14/598,471

(22) Filed: Jan. 16, 2015

(65) Prior Publication Data

US 2015/0196137 A1 Jul. 16, 2015

(30) Foreign Application Priority Data

Jan. 16, 2014 (CN) ..... 2014 1 0021415
Feb. 27, 2014 (CN) ..... 2014 1 0069437
Jan. 7, 2015 (CN) ..... 2015 1 0009391

(51) Int. Cl.
*A47D 13/00* (2006.01)
*A47D 13/10* (2006.01)
*A47D 1/00* (2006.01)

(52) U.S. Cl.
CPC ..... *A47D 13/105* (2013.01); *A47D 1/00* (2013.01)

(58) Field of Classification Search
CPC ..... A47D 13/105; A47D 1/00; A47D 9/04
See application file for complete search history.

(56) References Cited

U.S. PATENT DOCUMENTS 3,851,343 A * 12/1974 Kinslow, Jr. ..... A47D 13/10 297/260.2
8,820,834 B2 * 9/2014 Harding ..... B60N 2/28 297/260.1

(Continued)

FOREIGN PATENT DOCUMENTS

CN 201008471 Y 1/2008
CN 201506378 U 6/2010

(Continued)

OTHER PUBLICATIONS

English Translations of Foreign (i.e. Chinese) reference Abstracts.

(Continued)

*Primary Examiner* — David R Dunn
*Assistant Examiner* — Tania Abraham
(74) *Attorney, Agent, or Firm* — Baker & McKenzie LLP; David I. Roche

(57) ABSTRACT

An infant chair apparatus includes a support base, a seat frame, a support base and a motion driving module. The seat frame is pivotally supported on the support base by an upright column, the seat frame being rotatable relative to the support base about a pivot axis, and the upright column including a column portion affixed with an underside of the seat frame. The motion driving module is attached with the support base, and includes a driving part that is arranged below the seat frame at a location offset from the pivot axis, the motion driving module being operable to cause reciprocated rotation of the driving part that imparts a substantially horizontal oscillating motion to the column portion and the seat frame.

27 Claims, 15 Drawing Sheets

(56) References Cited

U.S. PATENT DOCUMENTS

| | | | | |
|---|---|---|---|---|
| 8,950,020 | B2 * | 2/2015 | D'Arrigo | A47D 9/04 5/105 |
| 8,967,716 | B2 * | 3/2015 | Mountz | A47C 9/02 297/256.12 |
| 2008/0179928 | A1 | 7/2008 | Chen et al. | |
| 2009/0064410 | A1 * | 3/2009 | Cohen | A47D 9/02 5/109 |
| 2009/0200846 | A1 * | 8/2009 | Yehuda | A47D 9/04 297/271.5 |
| 2010/0052376 | A1 | 3/2010 | Hopke et al. | |
| 2012/0133185 | A1 * | 5/2012 | Tuckey | A47C 4/02 297/344.21 |
| 2013/0229040 | A1 | 9/2013 | Mountz | |

FOREIGN PATENT DOCUMENTS

| | | | |
|---|---|---|---|
| CN | 101773344 | A | 7/2010 |
| CN | 201624403 | U | 11/2010 |
| CN | 102210531 | A | 10/2011 |
| CN | 202077958 | U | 12/2011 |
| DE | 112007002469 | T5 | 9/2009 |
| GB | 2241433 | A | 9/1991 |
| GB | 2500111 | A | 9/2013 |
| KR | 1020120045816 | A | 5/2012 |
| WO | 2008115986 | A1 | 9/2008 |

OTHER PUBLICATIONS

Official Action from UK Patent Application No. GB1500852.7 dated May 27, 2015.

The Office Action issued on Nov. 26, 2015 in corresponding DE Patent Application No. 102015100572.7.

English Translation DE Office Action dated Nov. 26, 2015.

Search Report in co-pending CN Appl. No. 201500093918 dated Dec. 8, 2016.

* cited by examiner

INFANT CHAIR APPARATUS

CROSS-REFERENCE TO RELATED APPLICATION(S)

This patent application claims priority to China Patent Application No. 201410021415.7 filed on Jan. 16, 2014; to China Patent Application No. 201410069437.0 filed on Feb. 27, 2014; and to China Patent Application No. 201510009391.8 filed on Jan. 7, 2015, which are incorporated herein by reference.

BACKGROUND

1. Field of the Invention

The present invention relates to infant chair apparatuses.

2. Description of the Related Art

Infant swing apparatuses have become common household items. An infant swing has the primary function of applying a gentle, swinging or gliding motion to soothe a child, while providing a safe and comfortable seating area. However, one main drawback of the current infant swings is that they are generally built with large standing frames that are complicated to fold or disassemble. This makes travelling with an infant swing all the more difficult.

Therefore, there is a need for an apparatus for soothing a child that is more convenient in use, and can address at least the foregoing issues.

SUMMARY

The present application describes an infant chair apparatus that is compact in size and can apply a gently oscillating motion to soothe a child. The infant chair apparatus includes a support base, a seat frame, a support base and a motion driving module. The seat frame is pivotally supported on the support base by an upright column, the seat frame being rotatable relative to the support base about a pivot axis, and the upright column including a column portion affixed with an underside of the seat frame. The motion driving module is attached with the support base, and includes a driving part that is arranged below the seat frame at a location offset from the pivot axis, the motion driving module being operable to cause reciprocated rotation of the driving part that imparts a substantially horizontal oscillating motion to the column portion and the seat frame.

DETAILED DESCRIPTION OF THE EMBODIMENTS

Figure 1:
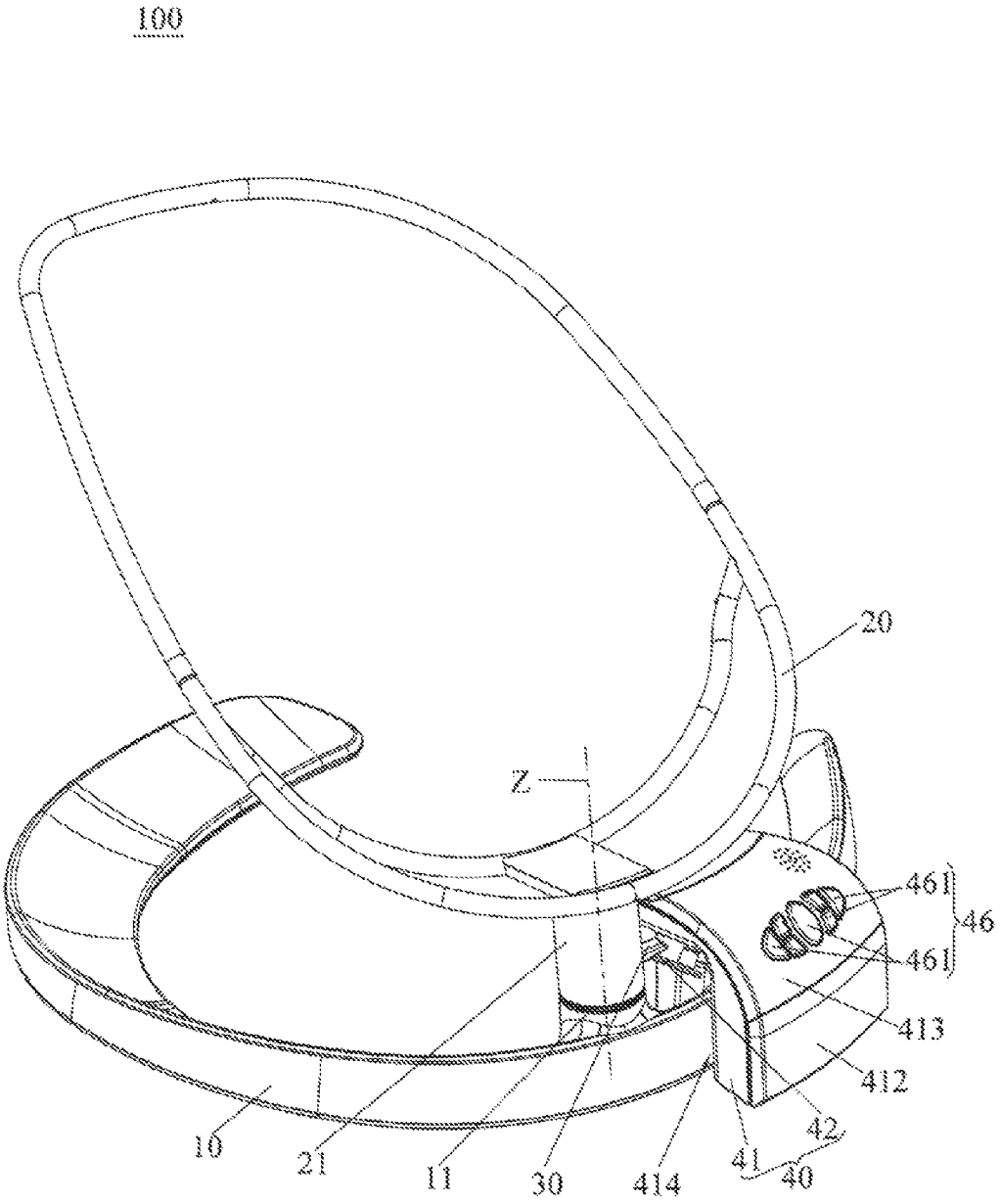
FIG. 1 is a schematic view illustrating an embodiment of an infant chair apparatus.
Figure 2:
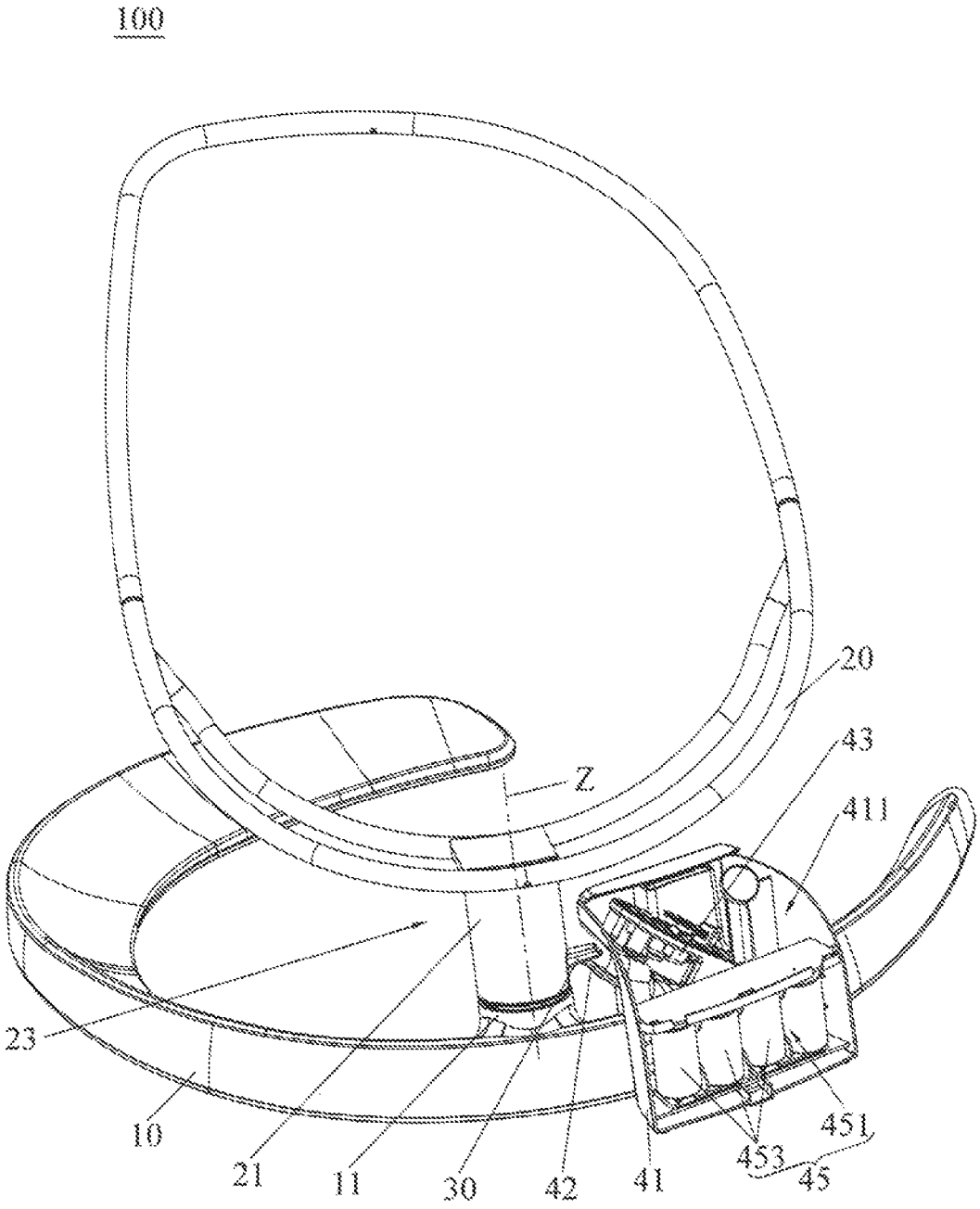
FIG. 2 is a schematic view illustrating the construction of a motion driving module used in the infant chair apparatus shown in FIG. 1.
Figure 3:
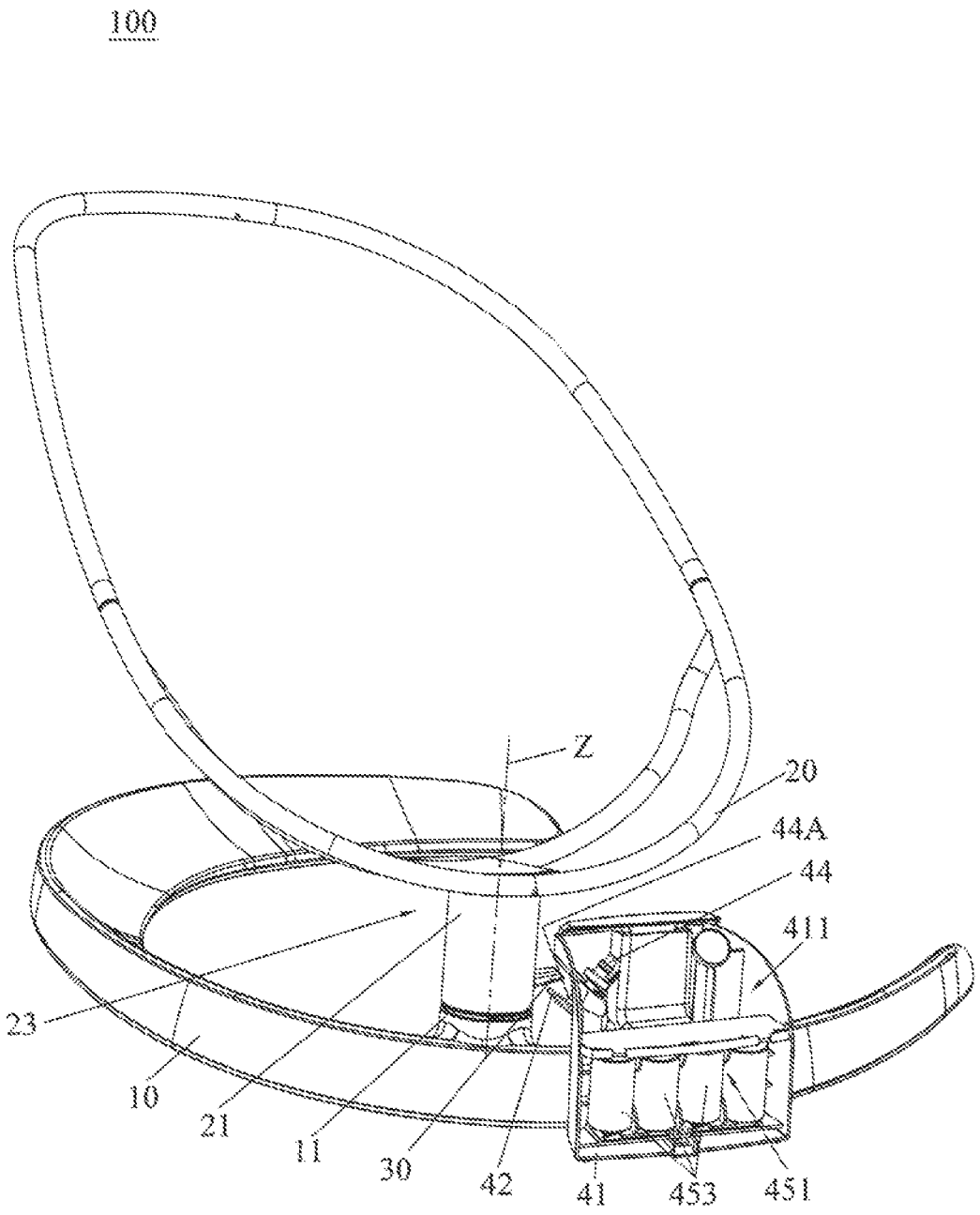
FIG. 3 is another schematic view illustrating the construction of the motion driving module shown in FIG. 2 with the representation of certain parts being omitted.

FIGS. 1-5 and FIG. 7 are schematic views illustrating an embodiment of an infant chair apparatus 100. The infant chair apparatus 100 includes a support base 10, a seat frame 20 and a motion driving module 40. In the illustrated embodiment, the support base 10 can exemplary have an arc shape capable of providing a stable resting contact on a floor surface to support the seat frame 20. However, the support base 10 is not limited to the shown shape, and any other shapes suitable for providing stable support may also be applicable.

The seat frame 20 is supported above the support base 10 by an upright column 23. The upright column 23 generally rises upward from the support base 10, and can be vertical or slightly inclined relative to a vertical direction. The upright column 23 can include a column portion 21 affixed with an underside of the seat frame 20 and projecting downward, and another column portion 11 affixed with the support base 10 and projecting upward. The two column portions 21 and 11 can be exemplary coupling shells. The two column portions 21 and 11 can be pivotally connected with each other about a pivot axis Z. The pivot axis Z rises upward along the upright column 23, and can be substantially parallel to a vertical direction, a slight inclination of the pivot axis Z relative to the vertical axis being possible. The seat frame 20 is thereby pivotally supported on the support base 10 about the pivot axis Z, and is located at a position on the pivot axis Z. In one embodiment, an elastic structure may be further provided in the column portion 21 and/or the column portion 11 that can facilitate rebound of the column portion 21 when it reaches a limit position. This rebound action can help to the seat frame 20 to rotate reversely once it reaches a limit position of its travel path.

The infant chair apparatus 100 can further include a rotation lock 30 assembled with the seat frame 20. More specifically, the rotation lock 30 can be assembled with the column portion 21, and extend outward from an outer surface of the column portion 21. The rotation lock 30 is rotationally locked with the seat frame 20, but can slide along a vertical direction and substantially parallel to the pivot axis Z between a lower or locking position, and an upper or release position. When it is in the lower position, the rotation lock 30 can engage with the support base 10 (e.g., a slot formed in the column portion 11) to prevent rotation of the seat frame 20. When it is in the upper position above the lower position, the lock member 30 is disengaged from the support base 10 to allow rotation of the seat frame 20 relative to the support base 10. In one embodiment, the rotation lock 30 can have a portion extending radially relative to the pivot axis Z to facilitate access to the rotation lock 30.

The motion driving module 40 is arranged outside the upright column 23. The motion driving module 40 can include a housing 41 affixed with the support base 10, and a driving part 42 pivotally connected with the housing 41. The driving part 42 is arranged below the seat frame 20 at a location offset from the pivot axis Z and near the column portion 21. The driving part 42 can perform a reciprocated rotation to drive the seat frame 20 to rotate in a reciprocated manner about the pivot axis Z. This reciprocated rotation or oscillating motion of the seat frame 20 about the pivot axis Z can help to entertain or soothe a child, and can be performed without effort from a caregiver who does not need to manually drive the seat frame 20 in movement.

The motion driving module 40 can be arranged so that the driving part 42 lies near the outer surface of the column portion 21 and can interact with the rotation lock 30 for driving the seat frame 20 in movement. When the rotation lock 30 is in the upper position, a rotation of the driving part 42 can cause the driving part 42 to contact and push against the rotation lock 30, which can thereby drive rotational displacement of the seat frame 20. When the rotation lock 30 in the lower position locking the seat frame 20 with the support base 10, the driving part 42 can travel past the rotation lock 30 without contacting the rotation lock 30. Accordingly, no driving force is transmitted to the seat frame 20 when the rotation lock 30 is in the lower position, and the rotation lock 30 and the seat frame 20 can remain stationary.

The driving part 42 can be exemplary formed as a single part having a leaf shape with one or more lobes. The driving part 42 can perform reciprocated rotation relative to the housing 41 to intermittently engage with the rotation lock 30, whereby a push force can be applied intermittently for imparting the reciprocated rotation to the seat frame 20. In one embodiment, the reciprocated rotation of the driving part 42 can be substantially synchronized with the oscillating motion of the seat frame 20 about the pivot axis Z, so that the driving part 42 can timely contact with the rotation lock 30 at each passage to apply the push action.

The motion driving module 40 can further include a drive actuator 43 and a rotary shaft 44 that are respectively arranged in the housing 41. The drive actuator 43 can be an electric motor disposed in an inner cavity 411 of the housing 41. The rotary shaft 44 is coupled with the drive actuator 43, and can have a portion 44A that is exposed outside the housing 41. The portion 44A of the rotary shaft 44 can extend downward at an inclined angle relative to a vertical direction toward the column portion 11 of the support base 10. The driving part 42 can be affixed with the portion 44A, and can extend radially relative to the axis of the rotary shaft 44 so as to be adjacent to the travel path of the rotation lock 30. The drive actuator 43 can drive the rotary shaft 44 in rotation, which in turn causes rotation of the driving part 42.

The motion driving module 40 further includes a power supply 45 that is disposed in the housing 41 and is electrically connected with the drive actuator 43. The power supply 45 can provide power for operating the drive actuator 43. In one embodiment, the power supply 45 can include a battery case 451 capable of receiving battery cells 453, and a cover 412 for closing and opening the battery case 451. The power supply 45 can further include an external power connector 452 that is connectible with an external power source for powering the drive actuator 43. Power can be supplied through the external power connector 452 in case no battery cells 453 are installed in the battery case 451, or the level of power remaining in installed battery cells 453 is insufficient for operating the drive actuator 43.

The motion driving module 40 can further include a control interface 46 that is electrically connected with the drive actuator 43. The control interface 46 can be located below the seat frame 20, and can include a plurality of buttons 461 operable to set various functions of the infant chair apparatus 100. In particular, the control interface 46 can be used to program or select a speed and/or direction of rotation of the drive actuator 43 for setting a desirable oscillating speed for the seat frame 20. In one embodiment, the buttons 461 can be arranged on a front cover 413 of the housing 41.

In one embodiment, the motion driving module 40 can further be configured as a detachable module that can be installed on and removed from the support base 10. Referring to FIGS. 4-7, the housing 40 can include a recessed portion 414 where a section 10A of the support base 10 can be received and removed. The recessed portion 414 can have an arcuate shape that matches with the curved section 10A of the support base 10. The motion driving module 40 can include a clamping member 50 assembled with the housing 41. The clamping member 50 can be movable to close at least partially the recessed portion 414 and engage with the housing 41 so as to retain the section 10A of the support base 10 in the recessed portion 414, whereby the motion driving module 40 can be fixedly attached with the support base 10. Moreover, the clamping member 50 can be operable to disengage from the housing 41 for removing the motion driving module 40 from the support base 10.

Figure 4:
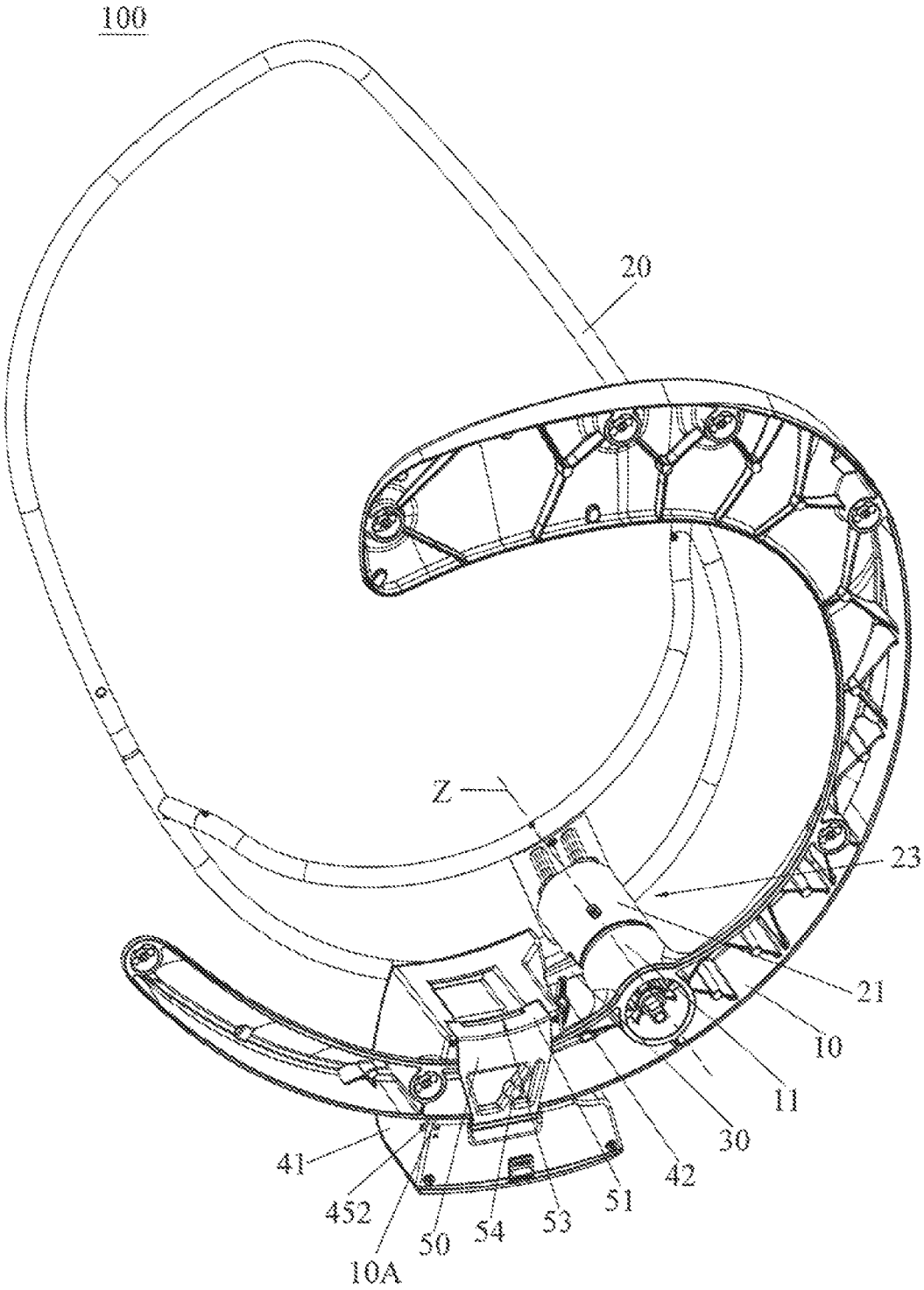
FIG. 4 is a schematic view illustrating how the motion driving module is fastened with a support base of the infant chair apparatus.
Figure 5:
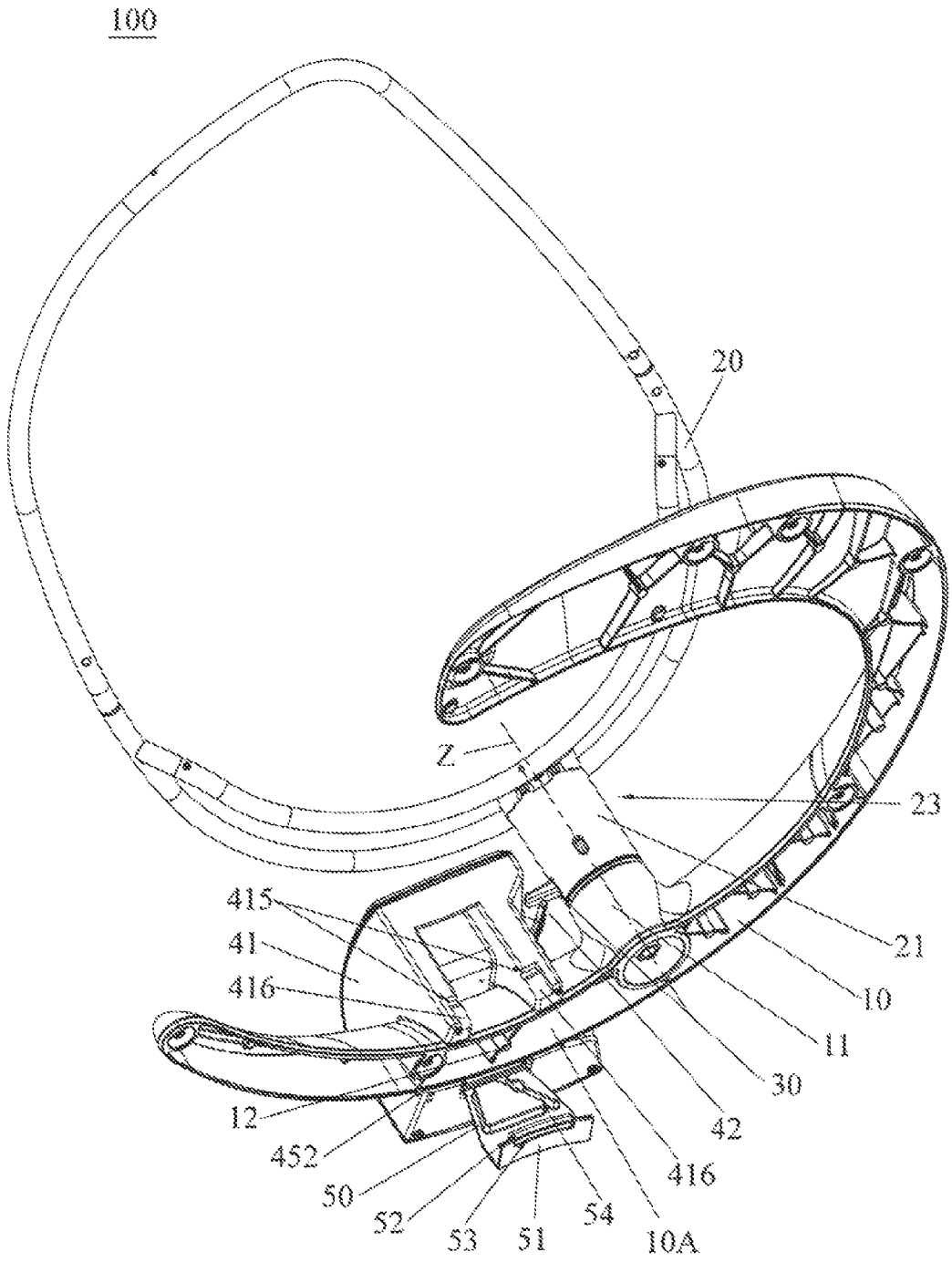
FIG. 5 is a schematic view illustrating a clamping member of the motion driving module in a disengaged state.
Figure 6:
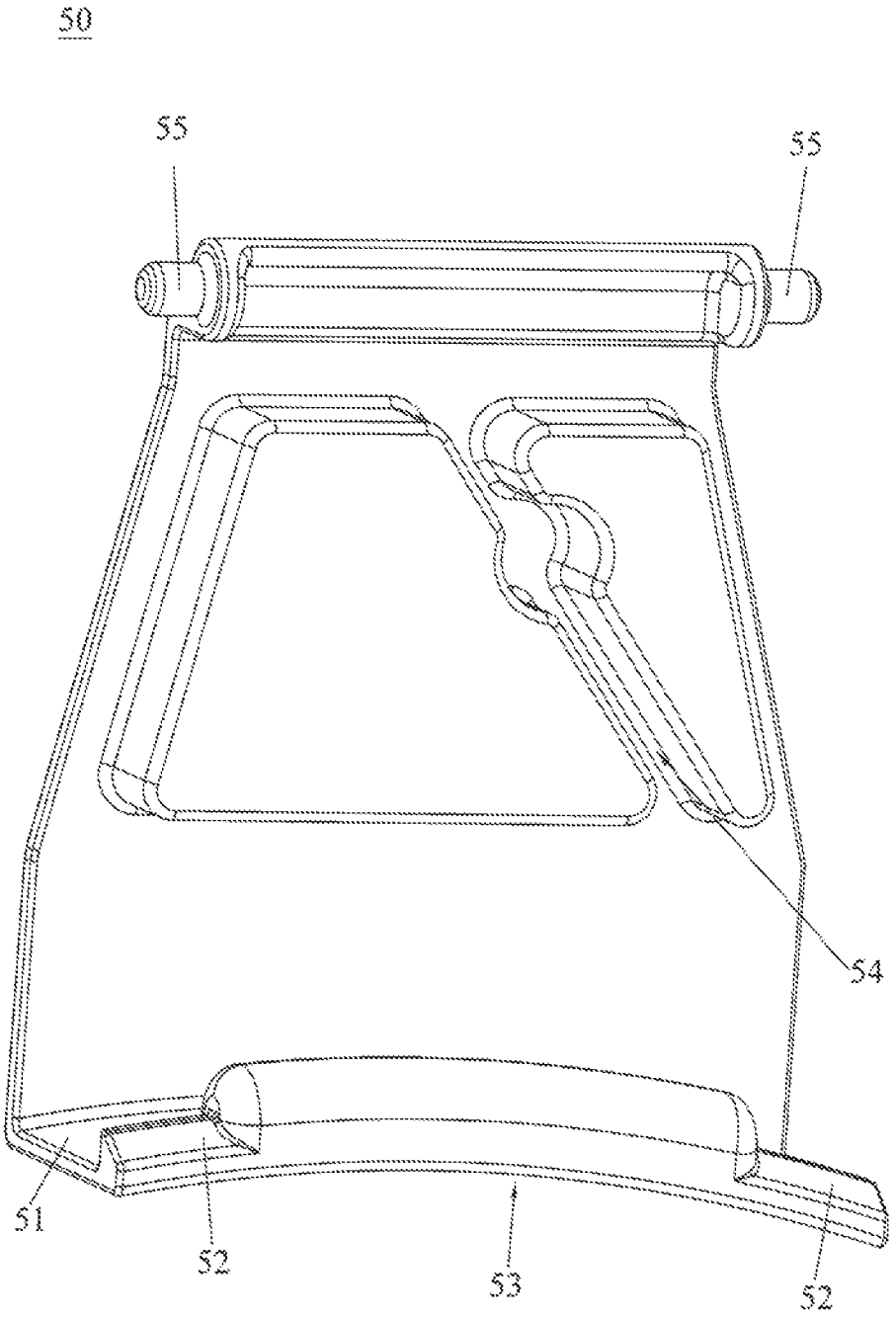
FIG. 6 is a perspective view illustrating the construction of the clamping member used for fastening the motion driving module with the support base.
Figure 7:
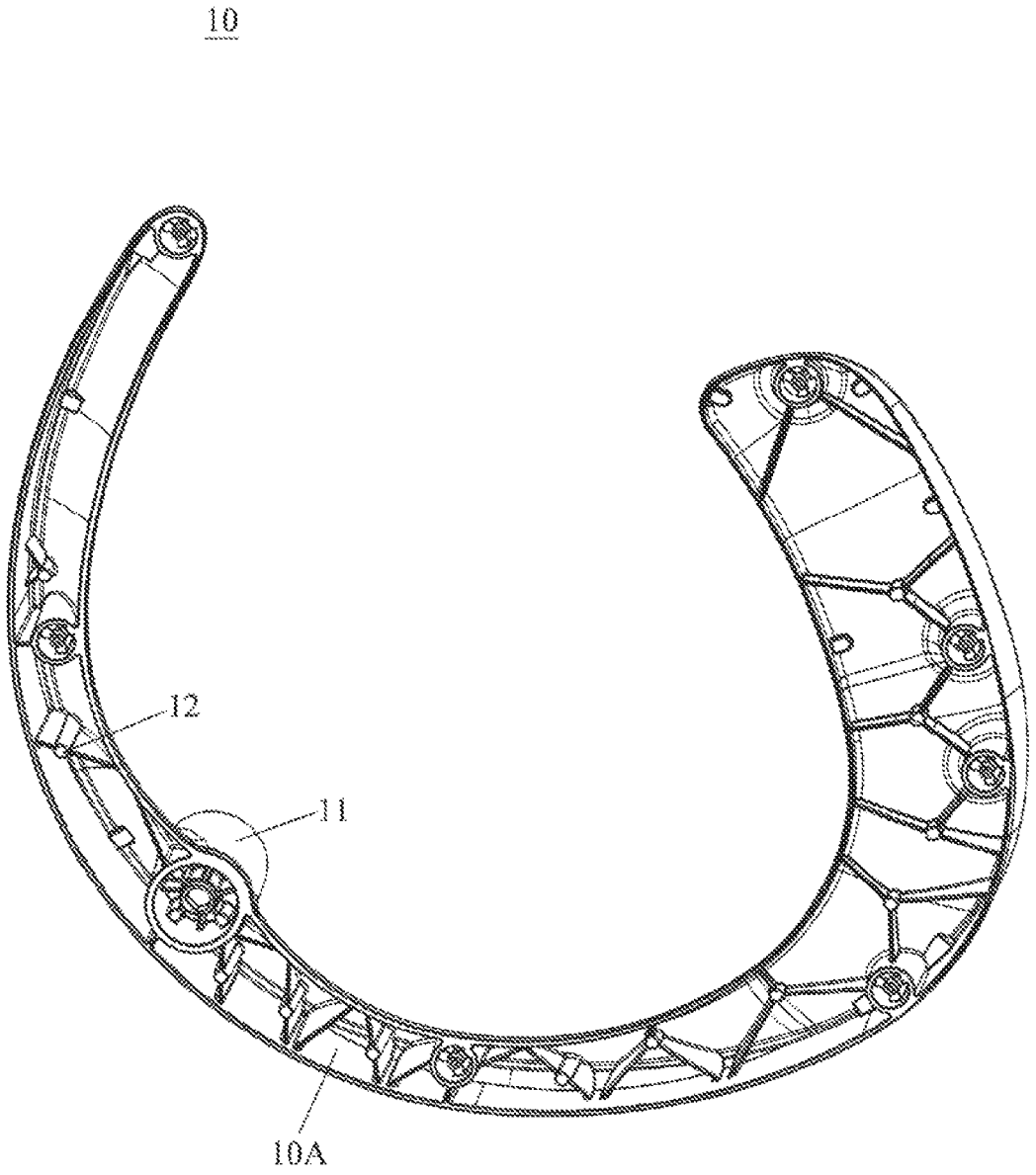
FIG. 7 is a schematic view illustrating alone the support base of the infant chair apparatus.

In conjunction with FIGS. 4 and 5, FIG. 6 is a schematic view illustrating the clamping member 50. In one embodiment, the clamping member 50 can be formed as a unitary body including two shaft portions 55 and a resilient arm 51 respectively provided at two opposite ends of the clamping member 50. The shaft portions 55 can be connected with the housing 41 adjacent to a side of the recessed portion 414 to pivotally assemble the clamping member 50 with the housing 41. The resilient arm 51 can project at a side of the clamping member 50, and can be formed with two lips 52 and a release pad 53. The clamping member 50 can further include a positioning structure 54 arranged in a region between the shaft portions 55 and the resilient arm 51. In one embodiment, the positioning structure 54 can exemplary be formed as a groove.

The housing 41 can have two spaced-apart grooves 415 located at a side of the recessed portion 414 opposite to the side where the shaft portions 55 of the clamping member 50 are pivotally connected with the housing 41. The housing 41 can further include two slant surfaces 416 that are respectively connected with the grooves 415.

Once the section 10A of the support base 10 is placed in the recessed portion 414 of the housing 41, the clamping member 50 can be rotated toward an underside of the section 10A. As the resilient arm 51 approaches the housing 41, the lips 52 can come in sliding contact with the slant surfaces 416, which push the resilient arm 51 to elastically deflect away from the slant surfaces 416. Once the lips 52 reach the grooves 415, the resilient arm 51 can elastically bias the lips 52 to engage with the grooves 415 to lock the clamping member 50 in place. The section 10A of the support base 10 can be thereby held with the motion driving module 40 by the clamping member 50.

When the lips 52 are engaged with the grooves 415, the positioning structure 54 of the clamping member 50 can engage with an alignment structure 12 affixed with the section 10A of the support base 10 to prevent slipping of the motion driving module 40 along the support base 10. The alignment structure 12 can be exemplary formed as a rib provided at an underside of the section 10A of the support base 10, and the grooved positioning structure 54 can automatically engage with the alignment structure 12 when the lips 52 are engaged with the grooves 415.

To remove the motion driving module 40 from the support base 10, the release pad 53 can be pulled to cause the lips 52 to disengage from the grooves 415, after which the clamping member 50 can be rotated to open the recessed portion 414. The motion driving module 40 then can be pulled upward away from the section 10A of the support base 10.

Reference is made hereinafter to FIGS. 1-7 to describe exemplary operation of the infant chair apparatus 100. For switching the infant chair apparatus 100 to an oscillating mode of operation, the motion driving module 40 can be attached with the support base 10 as described previously. A caregiver then can manually slide the rotation lock 30 from the lower position to the upper position shown in FIG. 1 to allow rotation of the seat frame 20 relative to the support base 10. The motion driving module 40 then can be powered on, and the drive actuator 43 can drive reciprocated rotation of the rotary shaft 44 and the driving part 42. As it is driven in rotation, the driving part 42 can approach and come into contact with the rotation lock 30, which can push the rotation lock 30 and the seat frame 20 in rotation. Each time it reaches a limit position, the seat frame 20 can rebound and rotate reversely, which can create a horizontal oscillating motion. The reciprocated rotation of the driving part 42 can allow the driving part 42 to intermittently contact and apply a push action on the rotation lock 30 in a periodical manner to sustain the oscillating motion of the seat frame 20. The caregiver can adjust the speed of the oscillating motion by using the buttons 461 of the control interface 46.

Figure 8:
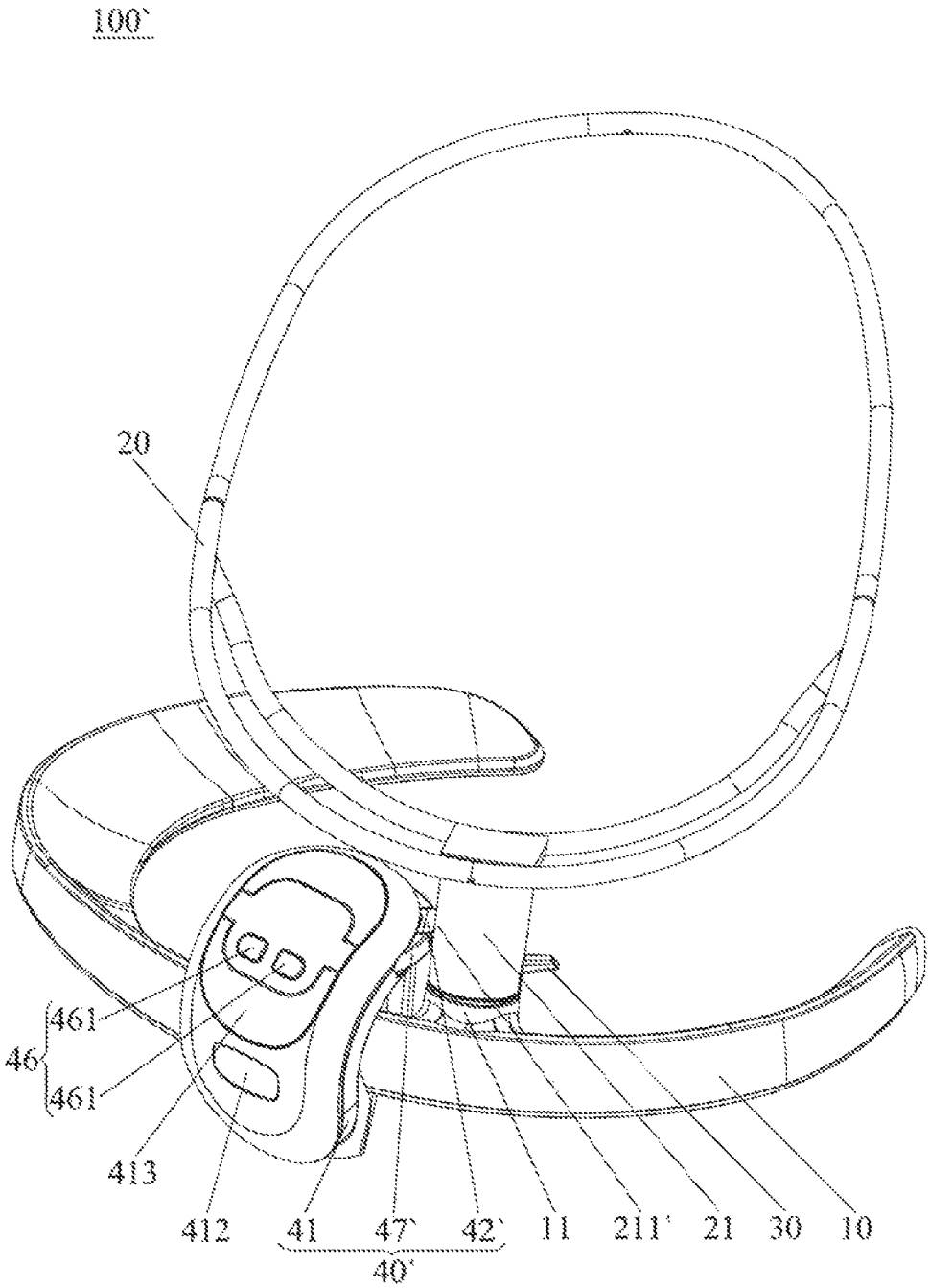
FIG. 8 is a schematic view illustrating another embodiment of an infant chair apparatus.
Figure 9:
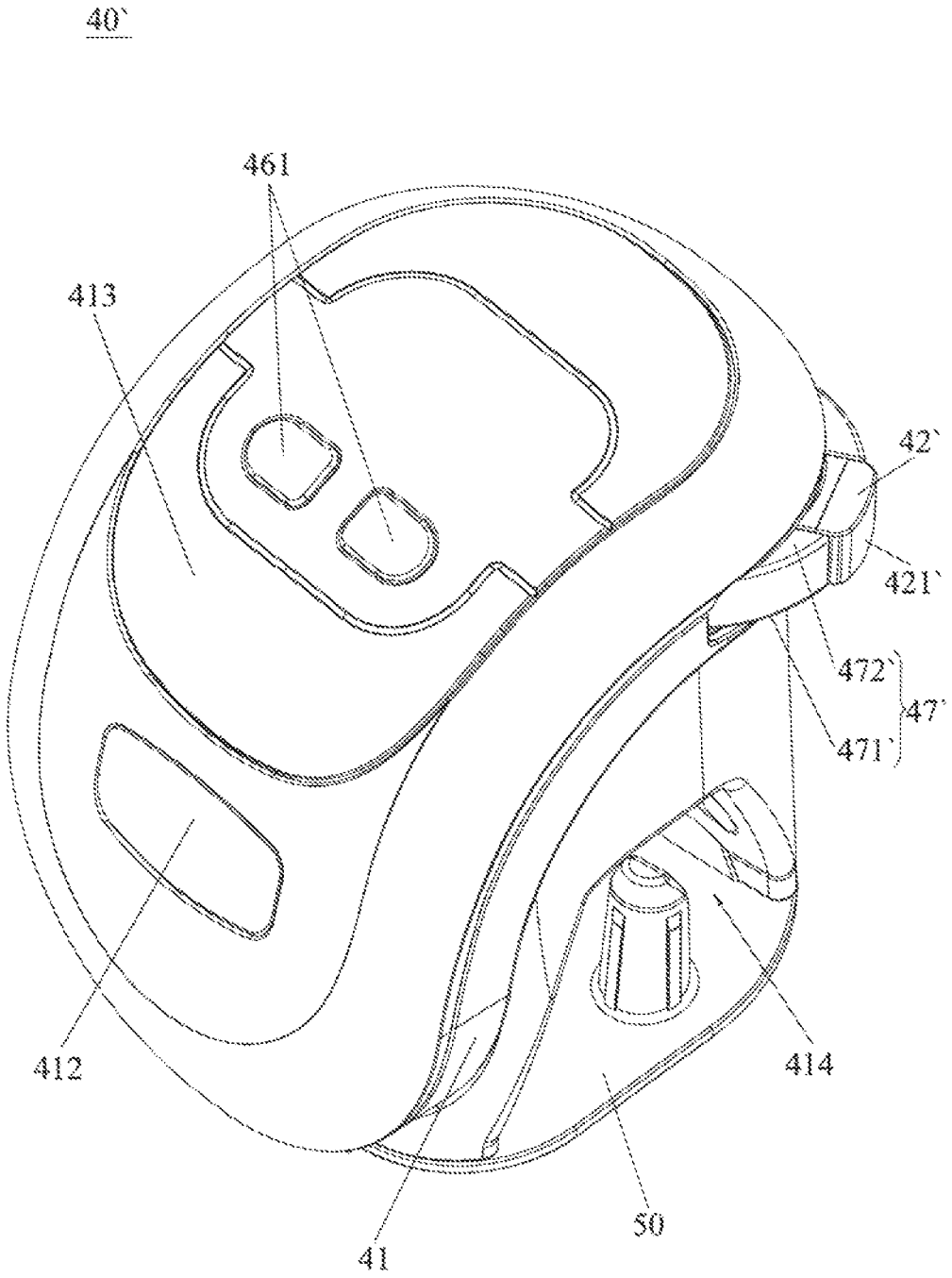
FIG. 9 is a schematic view illustrating a motion driving module used in the infant chair apparatus shown in FIG. 8.
Figure 10:
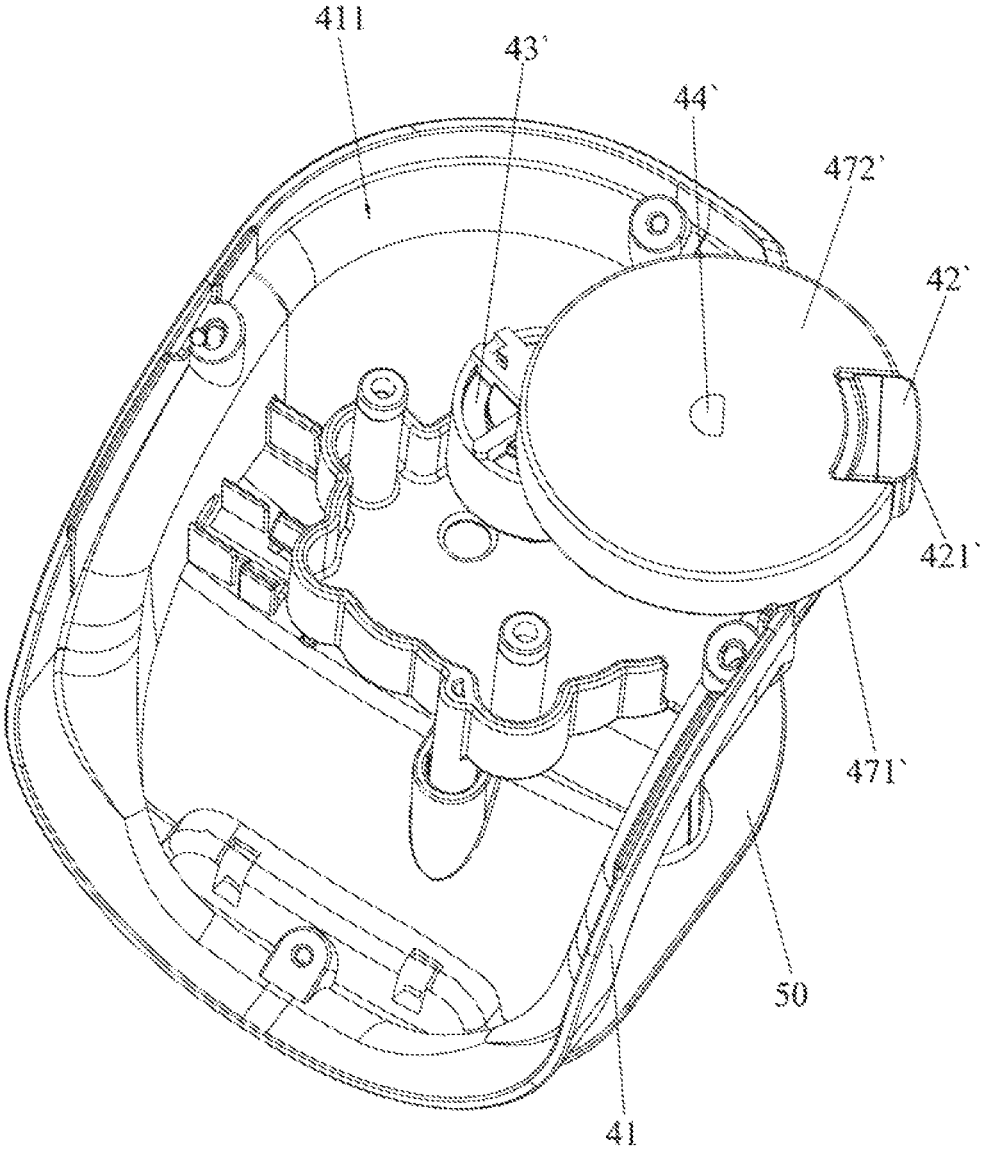
FIG. 10 is a schematic view illustrating an interior of the motion driving module shown in FIG. 9.
Figure 11:
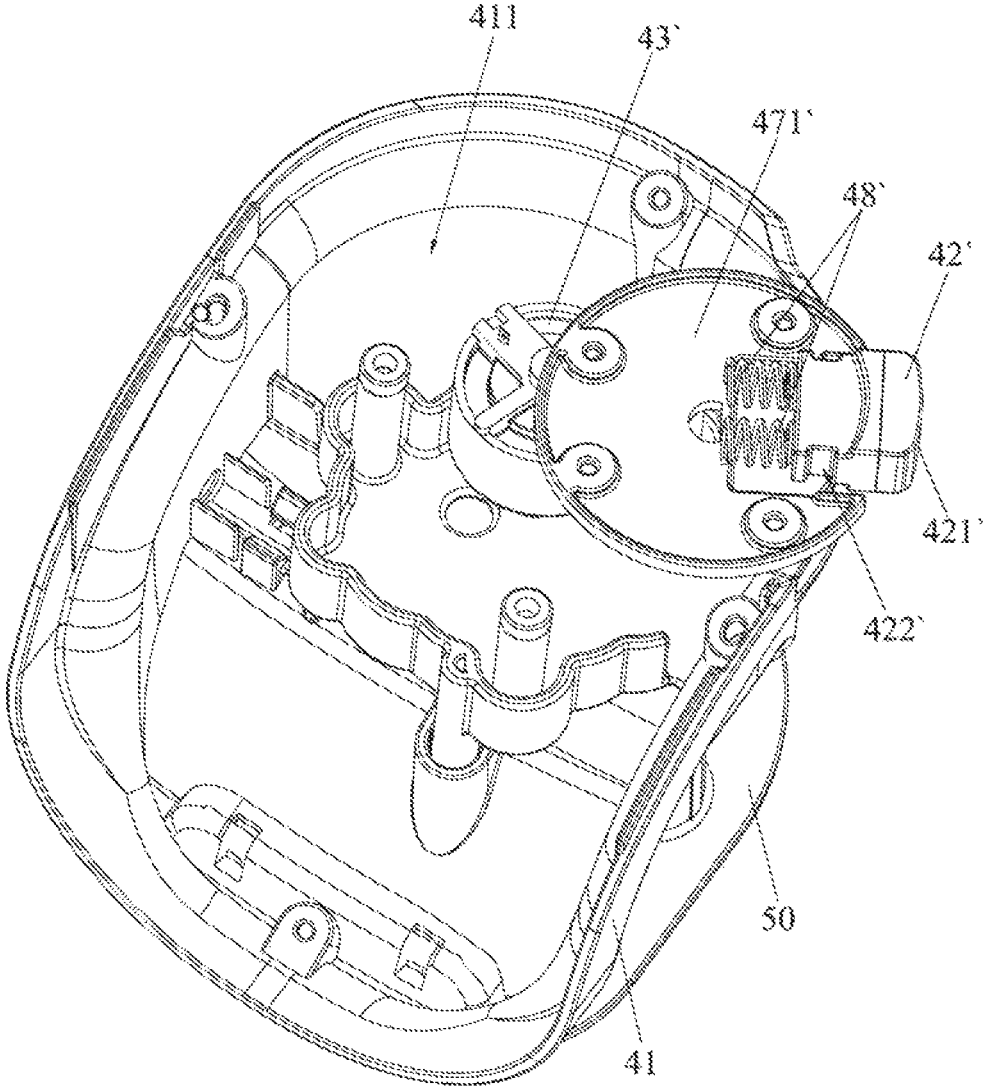
FIG. 11 is a schematic view illustrating the assembly of a driving part in the motion driving module shown in FIG. 9.
Figure 12:
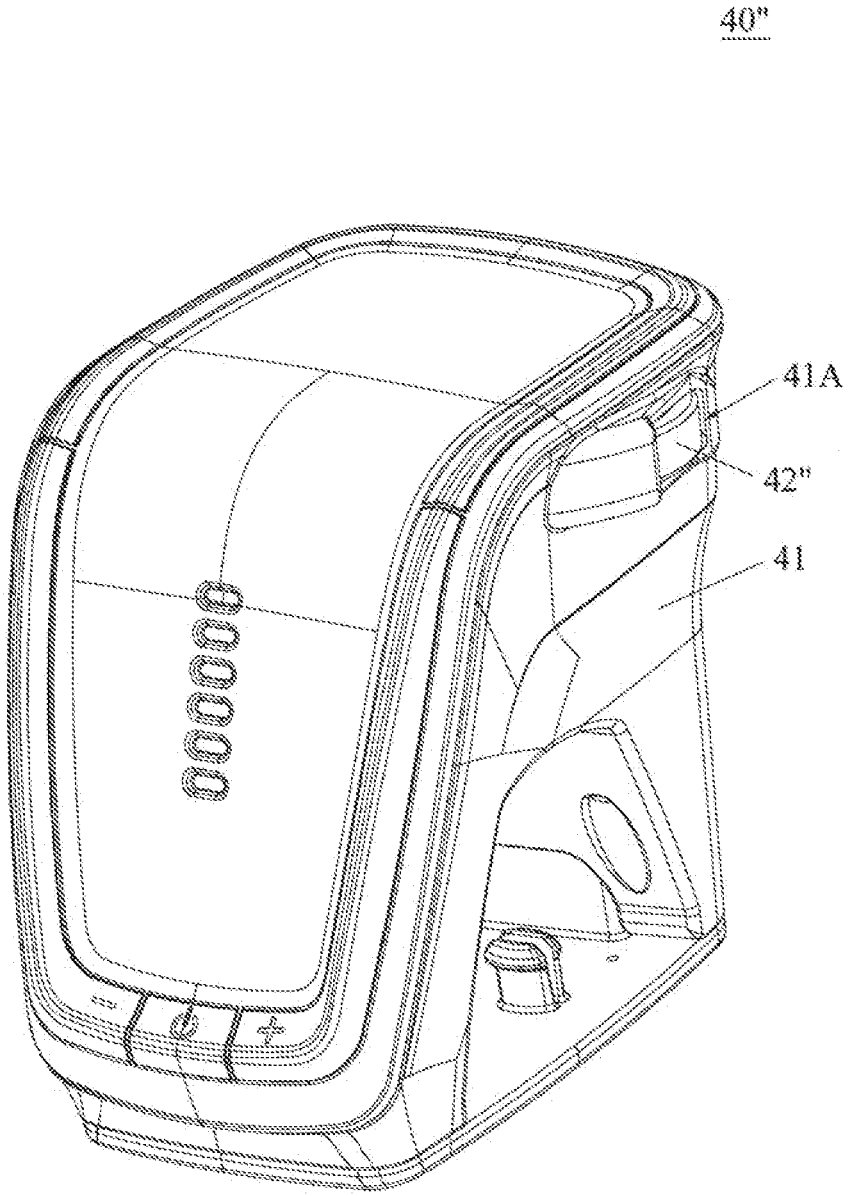
FIG. 12 is a schematic view illustrating another embodiment of a motion driving module that may be used in an infant chair apparatus.
Figure 13:
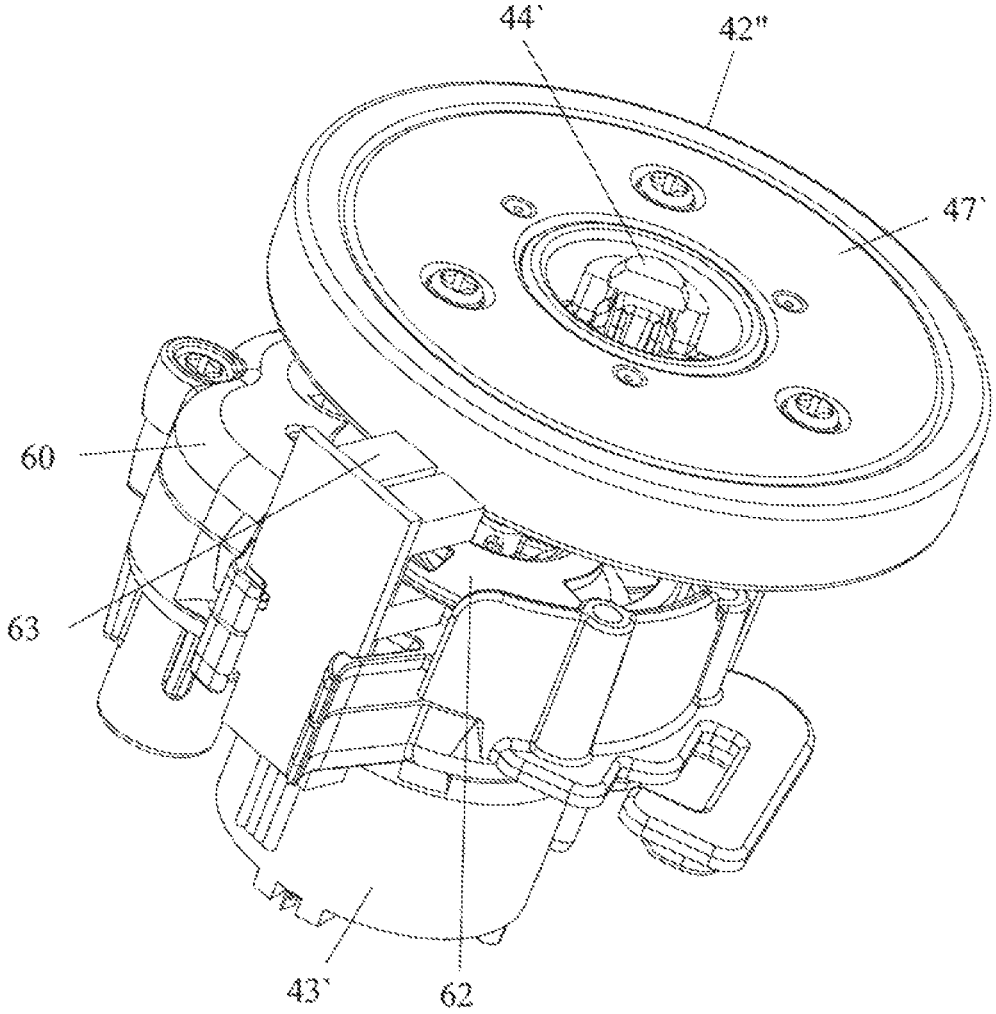
FIG. 13 is schematic view illustrating a construction of the motion driving module shown in FIG. 12.
Figure 14:
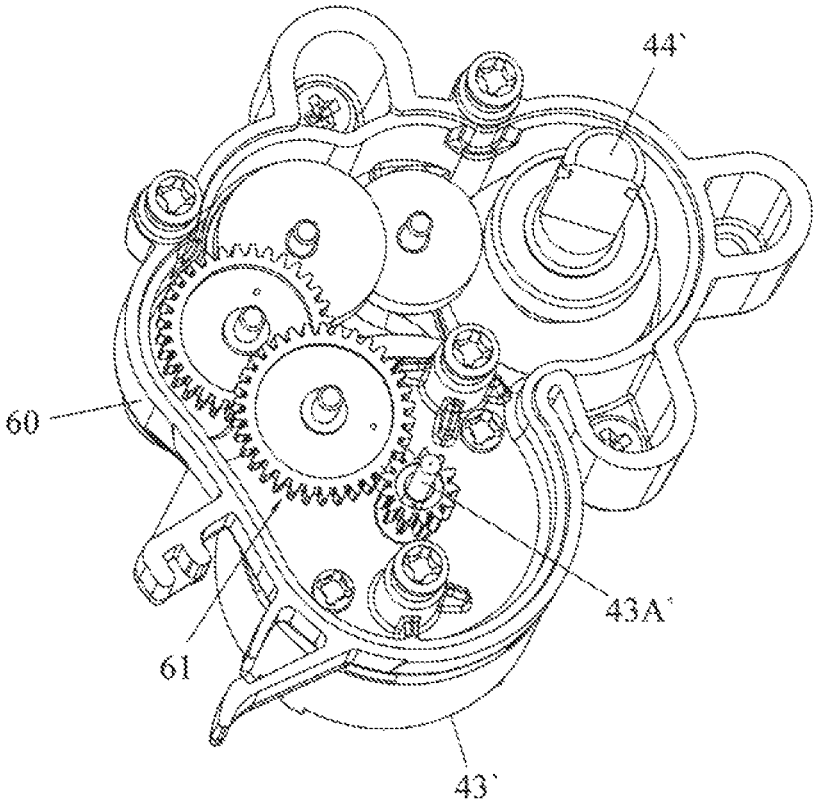
FIG. 14 is schematic view illustrating a gear box assembled in the motion driving module shown in FIG. 12.
Figure 15:
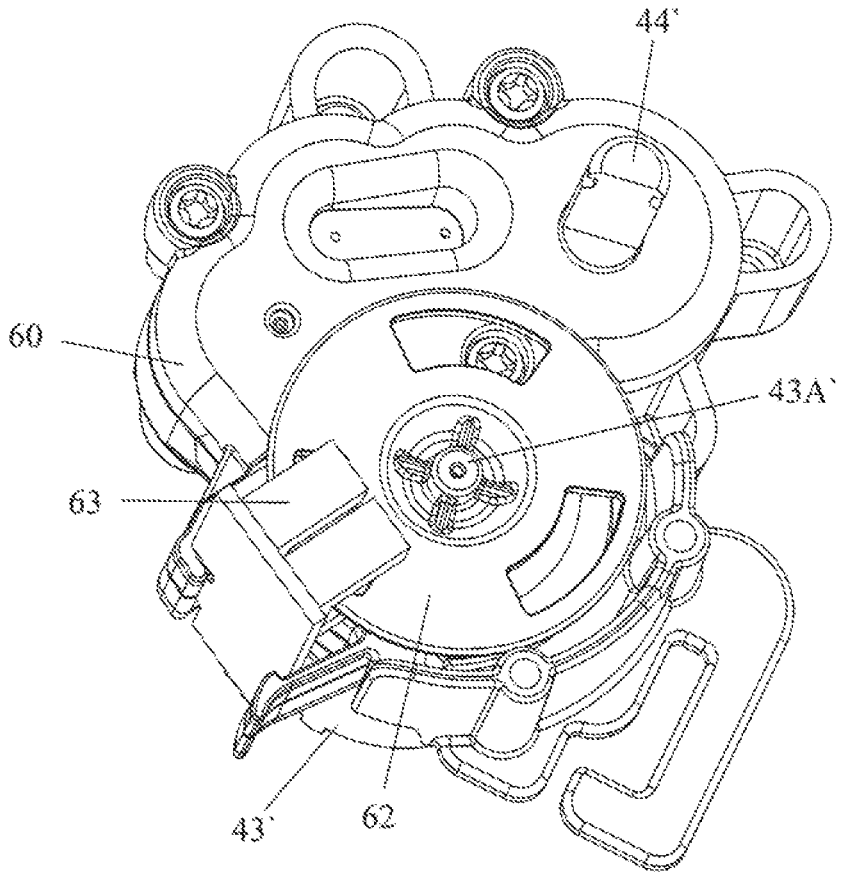
FIG. 15 is a schematic view illustrating the arrangement of an encoder wheel and optical system in the motion driving module shown in FIG. 12.

FIG. 8 is a schematic view illustrating another embodiment of an infant chair apparatus 100', and FIGS. 9-11 are schematic views illustrating the construction of a motion driving module 40' implemented in the infant chair apparatus 100'. The infant chair apparatus 100' differs from the infant chair apparatus 100 described previously in the construction of the motion driving module 40' and the way it interacts with the seat frame 20.

The motion driving module 40' can include a rotary frame 47', a driving part 42', a drive actuator 43' and a rotary shaft 44'. The rotary frame 47' is affixed with the rotary shaft 44', which in turn is pivotally connected with the housing 41 about a pivot axis spaced apart from the pivot axis Z of the seat frame 20. In one embodiment, the rotary frame 47' can exemplary have a cylindrical-like shape. Moreover, the rotary shaft 44' can extend substantially vertical and substantially parallel to the pivot axis Z of the seat frame 20.

The driving part 42' can be assembled with the rotary frame 47' for sliding displacement along a radial direction relative to the rotary shaft 44', but is rotationally coupled with the rotary frame 47'. For example, the rotary frame 47' can be formed by the assembly of a casing 471' and a cover 472' that define an inner guide channel along which the driving part 42' can be guided for sliding movement. The guide channel of the rotary frame 47' can further have fixed studs (not shown) respectively received in limiting slots 422' of the driving part 42' for delimiting the range of displacement of the driving part 42' relative to the rotary frame 47'. The driving part 42' can extend radially outward with respect to the pivot axis of the rotary frame 47', and has a radially distal end portion affixed with a frictional portion 421'. The rotary frame 47' can be arranged such that the frictional portion 421' of the driving part 42' is in constant rolling contact with a corresponding frictional portion 211' affixed with the column portion 21 of the seat frame 20. The frictional portion 211' can be exemplary affixed on the outer surface of the column portion 21.

For maintaining the driving part 42' in constant contact with the column portion 21, one or more spring 48' (two springs 48' are exemplary shown in FIG. 11) can be respectively connected with the driving part 42' and the rotary frame 47'. The springs 48' can be arranged so as to continuously bias the driving part 42' radially outward to press the frictional portion 421' against the frictional portion 211' of the column portion 21.

In some variant embodiment, the springs 48' may be omitted, the driving part 42' and/or frictional portion 421' can be made of an elastic material (e.g., elastomers), and the driving part 42' can be affixed with the rotary frame 47'. The elastic material can apply an elastic force that assists to maintain the frictional portion 421' in constant contact with the frictional portion 211' of the column portion 21.

The drive actuator 43' can be an electric motor operable to drive reciprocated rotation of the rotary shaft 44' and the driving part 42', which in turn can impart a horizontal swing motion to the seat frame 20 via the rolling contact between the frictional portion 421' of the driving part 42' and the frictional portion 211' of the column portion 21.

Reference is made hereinafter to FIGS. 8-11 to describe exemplary operation of the infant chair apparatus 100'. For switching the infant chair apparatus 100' to the oscillating mode of operation, a caregiver then can manually slide the rotation lock 30 from the lower position to the upper position shown in FIG. 1 to allow rotation of the seat frame 20 relative to the support base 10. The motion driving module 40' then can be powered on, and the drive actuator 43' can drive reciprocated rotation of the rotary frame 47' and the driving part 42'. Owing to the constant rolling contact between the driving part 42' and the column portion 21, the reciprocated rotation of the driving part 42' can impart a substantially horizontal oscillating motion to the seat frame 20. The caregiver can adjust the speed of the oscillating motion by using the buttons 461 of the control interface 46. Moreover, the caregiver can use the control interface 46 to stop rotation of the drive actuator 43', which can stop the seat frame 20.

FIGS. 12-15 are schematic views illustrating another embodiment of a motion driving module 40" operable to impart a substantially horizontal oscillating motion to the seat frame 20. Like previously described, the motion driving module 40" can include the housing 41 in which are respectively assembled the drive actuator 43', the rotary shaft 44' and the rotary frame 47'. The drive actuator 43' can be an electric motor having an output shaft 43A', and the rotary shaft 44' can be coupled with the output shaft 43A' of the drive actuator 43' via a gear box 60 comprised of a plurality of gears 61. The rotary frame 47' is affixed with the rotary shaft 44', and the driving part 42" is formed as a ring affixed with an outer circumference of the rotary frame 47'. The driving part 42" can be at least partially exposed outside the housing 41 through an opening 41A provided at a side of the housing 41.

Moreover, the output shaft 43A' of the drive actuator 43' can be affixed with an encoder wheel 62 arranged adjacent to an optical system 63. The assembly of the encoder wheel 62 and the optical system 63 can measure the rotation speed of the output shaft 43A' for controlling the oscillating motion of the seat frame 20.

It will be appreciated that the arrangement of the encoder wheel 62 may also be applicable to any of the embodiments described previously with reference to FIGS. 1-11.

Advantages of the structures described herein include the ability to provide an infant chair apparatuses that is compact in size, and can apply a gentle oscillating motion to soothe a child. The infant chair apparatus includes a motorized motion driving module that is arranged on the support base offset from the vertical pivot axis of the seat frame. The motion driving module can have a driving part rotatable to impart a substantially horizontal oscillating motion to the seat frame without external effort from a caregiver.

Realizations of the infant chair apparatuses have been described in the context of particular embodiments. These embodiments are meant to be illustrative and not limiting. Many variations, modifications, additions, and improvements are possible. These and other variations, modifications, additions, and improvements may fall within the scope of the inventions as defined in the claims that follow.

What is claimed is:

1. An infant chair apparatus comprising:

a support base;

a seat frame pivotally supported on the support base by an upright column, the seat frame being rotatable relative to the support base about a pivot axis, and the upright column including a column portion affixed with an underside of the seat frame; and a motion driving module including a housing, a drive actuator assembled with the housing in an interior thereof, a driving part coupled with the drive actuator, and a control interface assembled with the housing and connected with the drive actuator, the housing of the motion driving module being operable to detachably fasten with a section of the support base so that the motion driving module is attachable with and removable from the support base, the driving part being arranged below the seat frame at a location offset from the pivot axis when the motion driving module is attached with the support base, the motion driving module being operable to cause reciprocated rotation of the driving part that imparts a substantially horizontal oscillating motion to the column portion and the seat frame.

2. The infant chair apparatus according to claim 1, wherein the upright column is assembled with a rotation lock, the rotation lock being movable substantially parallel to the pivot axis between a first position for locking the seat frame with the support base, and a second position for unlocking the seat frame from the support base such that the seat frame is allowed to rotate about the pivot axis.

3. The infant chair apparatus according to claim 2, wherein the driving part is movable to contact with the rotation lock to drive the oscillating motion of the seat frame, when the rotation lock is in the second position.

4. The infant chair apparatus according to claim 3, wherein when the rotation lock is in the first position, the driving part is rotatable to travel past the rotation lock without contacting the rotation lock.

5. The infant chair apparatus according to claim 3, wherein the reciprocated rotation of the driving part causes the driving part to contact intermittently the rotation lock.

6. The infant chair apparatus according to claim 3, wherein the rotation lock projects radially relative to the pivot axis.

7. The infant chair apparatus according to claim 1, wherein the driving part is affixed with a rotary shaft that is coupled with the drive actuator.

8. The infant chair apparatus according to claim 7, wherein the rotary shaft is inclined at an angle relative to a vertical direction.

9. The infant chair apparatus according to claim 1, wherein the motion driving module further includes a clamping member connected with the housing, the clamping member being operable to detachably fasten a section of the support base with the housing.

10. The infant chair apparatus according to claim 1, wherein the motion driving module further includes a rotary frame affixed with a rotary shaft, and the driving part is connected with the rotary frame and extends radially relative to the rotary shaft to be in constant contact with the column portion.

11. The infant chair apparatus according to claim 10, wherein the rotary shaft extends substantially parallel to the pivot axis.

12. The infant chair apparatus according to claim 10, wherein the driving part is in constant rolling contact with the column portion.

13. The infant chair apparatus according to claim 10, wherein the driving part is spring biased to remain in constant contact with the column portion.

14. The infant chair apparatus according to claim 10, wherein the driving part is assembled with the rotary frame for sliding displacement along a radial direction, and the motion driving module further includes a spring respectively connected with the rotary frame and the driving part.

15. The infant chair apparatus according to claim 1, wherein the control interface is located below the seat frame when the motion driving module is attached with the support base, the control interface including a plurality of buttons operable to set various functions of the infant chair apparatus.

16. The infant chair apparatus according to claim 1, wherein the driving part is affixed with a rotary shaft that is driven in rotation by the drive actuator, the drive actuator being an electric motor having an output shaft that is affixed with an encoder wheel.

17. The infant chair apparatus according to claim 1, wherein the housing includes a recessed portion for removably receiving a section of the support base.

18. The infant chair apparatus according to claim 17, wherein the motion driving module further includes a clamping member connected with the housing, the clamping member being operable to close at least partially the recessed portion and engage with the housing so as to retain a section of the support base in the recessed portion.

19. The infant chair apparatus according to claim 18, wherein when a section of the support base is received in the recessed portion, the clamping member is rotatable toward an underside of the section of the support base to close at least partially the recessed portion.

20. The infant chair apparatus according to claim 19, further including a positioning structure configured to prevent slipping of the motion driving module along the support base once the clamping member closes at least partially the recessed portion and retains a section of the support base in the recessed portion.

21. The infant chair apparatus according to claim 20, wherein the positioning structure is provided on the clamping member, the positioning structure engaging with a section of the support base received in the recessed portion when the clamping member closes at least partially the recessed portion.

22. The infant chair apparatus according to claim 21, wherein the positioning structure is a groove.

23. An infant chair apparatus comprising:

a support base;

a seat frame pivotally supported on the support base by an upright column, the seat frame being rotatable relative to the support base about a pivot axis, and the upright column including a column portion affixed with an underside of the seat frame, the upright column further being assembled with a rotation lock, the rotation lock being movable substantially parallel to the pivot axis between a first position for locking the seat frame with the support base and a second position for unlocking the seat frame from the support base such that the seat frame is allowed to rotate about the pivot axis; and a motion driving module attached with the support base and including a driving part that is arranged below the seat frame at a location offset from the pivot axis, the motion driving module being operable to cause reciprocated rotation of the driving part that imparts a substantially horizontal oscillating motion to the column portion and the seat frame.

24. The infant chair apparatus according to claim 23, wherein the rotation lock projects radially relative to the pivot axis.

25. The infant chair apparatus according to claim 23, wherein the driving part is movable to contact with the rotation lock to drive the oscillating motion of the seat frame, when the rotation lock is in the second position.

26. The infant chair apparatus according to claim 25, wherein when the rotation lock is in the first position, the driving part is rotatable to travel past the rotation lock without contacting the rotation lock.

27. The infant chair apparatus according to claim 25, wherein the reciprocated rotation of the driving part causes the driving part to contact intermittently the rotation lock.

* * * * *